US007009347B2

(12) United States Patent
Henze

(10) Patent No.: US 7,009,347 B2
(45) Date of Patent: Mar. 7, 2006

(54) MULTIPLE DISCHARGE LOAD ELECTRONIC BALLAST SYSTEM

(75) Inventor: Christopher P. Henze, Lakeville, MN (US)

(73) Assignee: Nicollet Technologies Corporation, Mpls., MN (US)

( * ) Notice: Subject to any disclaimer, the term of this patent is extended or adjusted under 35 U.S.C. 154(b) by 0 days.

(21) Appl. No.: 10/760,972

(22) Filed: Jan. 20, 2004

(65) Prior Publication Data

US 2005/0156541 A1 Jul. 21, 2005

(51) Int. Cl.
*H05B 41/16* (2006.01)

(52) U.S. Cl. ..... 315/246; 315/209 R; 315/249; 315/250; 315/291; 191/2

(58) Field of Classification Search ..... 315/246, 315/249, 250, 252, 254, 255, 291, 209 R; 363/34, 37, 51, 65, 56.02, 108, 109, 121, 363/124, 132, 143; 307/45, 58, 82, 86; 320/118, 320/125, 140, 149
See application file for complete search history.

(56) References Cited

U.S. PATENT DOCUMENTS

| | | | | |
|---|---|---|---|---|
| 4,100,476 | A | 7/1978 | Ghiringhelli | 315/297 |
| 4,286,193 | A | 8/1981 | King, Jr. et al. | 315/175 |
| 4,663,569 | A | 5/1987 | Alley et al. | 315/175 |
| 4,742,276 | A | 5/1988 | Ku | 315/106 |
| 5,144,205 | A | 9/1992 | Motto et al. | 315/244 |
| 5,233,273 | A | 8/1993 | Waki et al. | 315/224 |
| 5,374,875 | A | 12/1994 | Shackle et al. | 315/247 |
| 5,406,174 | A | 4/1995 | Slegers | 315/219 |
| 5,410,220 | A | 4/1995 | von Hertzen | 315/209 |
| 5,574,338 | A | 11/1996 | Kuusisto et al. | 315/307 |
| 5,803,215 | A | 9/1998 | Henze et al. | 191/2 |
| 5,900,701 | A | 5/1999 | Guhilot et al. | 315/307 |
| 5,926,004 | A | 7/1999 | Henze | 320/109 |
| 6,323,603 | B1 | 11/2001 | Persson | 315/290 |
| 6,326,740 | B1 | 12/2001 | Chang et al. | 315/291 |
| 6,362,575 | B1 | 3/2002 | Chang et al. | 315/224 |
| 6,370,050 | B1 * | 4/2002 | Peng et al. | 363/98 |
| 6,445,137 | B1 | 9/2002 | Okamoto et al. | 315/246 |
| 6,509,697 | B1 * | 1/2003 | Ervin et al. | 315/248 |
| 6,788,033 | B1 * | 9/2004 | Vinciarelli | 323/225 |

OTHER PUBLICATIONS

"Power Electronics: Converters, Applications, and Design", N. Mohan, T.M. Undeland and W.P. Robbins, *John Wiley & Sons*, 1989, pp. 81-83, 103-104, 115-116 and 378-381.

* cited by examiner

*Primary Examiner*—Haissa Philogene
(74) *Attorney, Agent, or Firm*—Westman, Champlin & Kelly

(57) ABSTRACT

An embodiment of the present invention pertains to a multiple discharge load electronic ballast system, including a distribution bus and a plurality of electronic ballasts. The distribution bus has a nominal distribution power rating. The plurality of electronic ballasts are operatively coupled to the distribution bus. A respective electronic ballast comprises adaptations for DC voltage control and an alternating current (AC) output, and has a maximum ballast power rating. A sum of the maximum ballast power ratings of the plurality of electronic ballasts is greater than the nominal distribution power rating of the distribution bus.

32 Claims, 2 Drawing Sheets

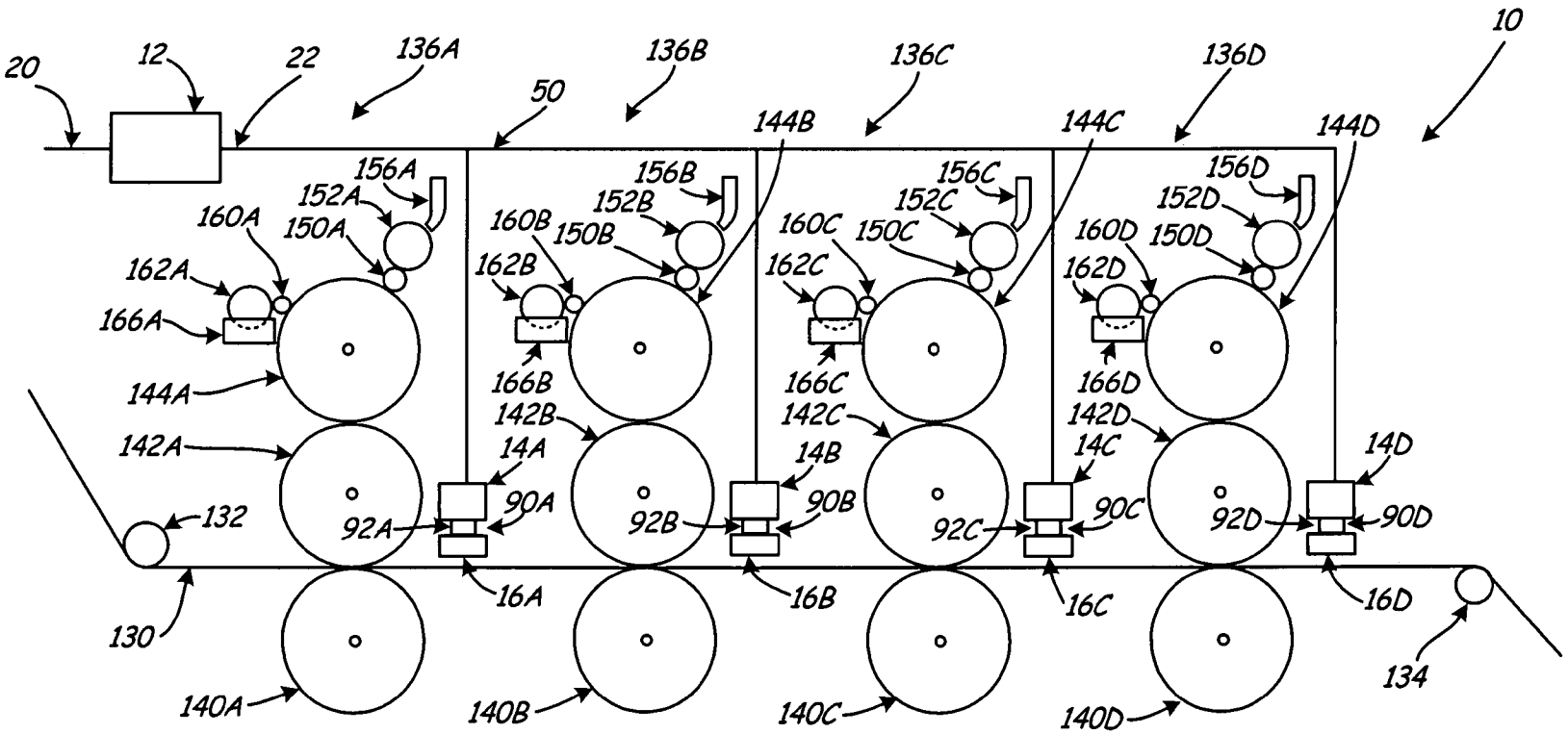
10
12
20
22
50
130
132
134
136A
136B
136C
136D
140A
140B
140C
140D
142A
142B
142C
142D
144A
144B
144C
144D
150A
150B
150C
150D
152A
152B
152C
152D
156A
156B
156C
156D
160A
160B
160C
160D
162A
162B
162C
162D
166A
166B
166C
166D
14A
14B
14C
14D
16A
16B
16C
16D
90A
90B
90C
90D
92A
92B
92C
92D

MULTIPLE DISCHARGE LOAD ELECTRONIC BALLAST SYSTEM

FIELD OF THE INVENTION

The present invention pertains to power supply and control ballasts, and particularly, to electronic power supply and control ballasts for powering alternating current discharge loads.

BACKGROUND OF THE INVENTION

Many applications call for the operation of alternating current (AC) discharge loads such as discharge lamps, including ultraviolet (UV) discharge lamps. For example, UV lamps are used for curing inks in printing systems. Many other uses for UV lamps are popular, representative examples of which include curing furniture varnish or heat-sensitive substrates, decontaminating food substances, sterilizing medical equipment or contact surfaces, optically pumping solid state lasers, electrically neutralizing surfaces, inducing skin tanning, and passing through fluorescent coatings to provide visible illumination. Additional uses for discharge lamps in other wavelengths are also popular, such as visible wavelength discharge lamps for providing illumination.

It is often desired for multiple discharge lamps to operate together as part of a system. For instance, in printing operations, it is common for separate discharge lamps to be used to cure each color ink that is applied, or for each step in a printing process.

Discharge lamps must be supplied with electrical power. Electrical power is normally derived from a standard AC utility source, which typically drives the primary sides of ballast transformers, the secondary sides of which provide electricity to the lamps.

A gas discharge lamp applies this electricity to the gas or vapor within a lamp. Several varieties of gas or vapor are used in gas discharge lamps. Mercury vapor is a popular choice; other gas discharge lamps are based on gallium, halogen, metal halide, xenon, sodium, or other varieties. Whatever particular chemistry is used, the electricity ionizes the gas within the lamp, so that when electrons recombine with ions, light is emitted. This discharge light is alternately described as an arc, a glow, or a corona.

For a gas molecule to ionize, a minimum threshold electric field must be applied to it. A lesser field will only polarize gas molecules without causing ionization. So, an ignition voltage is typically required for a discharge lamp to achieve ionization of the gas molecules.

Once ionization begins, it initially drives a positive feedback chain reaction as the initially freed electrons collide with other polarized molecules close to the ionization energy and provide the extra energy needed to ionize. As the populations of ionized molecules and free electrons rise, the rate of recombination also rises, until an equilibrium is reached where the rate of new ionizations is equal to the rate of recombinations. A discharge load goes from the initial equilibrium with no current, through the unstable ignition transition with negative resistance, to the new operating equilibrium.

It is typically desirable to compensate for the negative resistance of the discharge load during the ignition transition, and to provide a lower voltage than the ignition voltage when the ionization equilibrium has been achieved. An enhanced level of current is often used for warm-up, while a lower run level of current is required to maintain normal operation.

A discharge lamp will therefore have a rated operating current and a rated operating voltage, while the actual values of current and voltage through the lamp outside of normal operation, such as during ignition and warm-up, may vary considerably. Discharge lamps come in a wide range of sizes, and a correspondingly wide range of current, voltage, and power ratings. The voltage and power ratings on many lamps are considerably high.

The current, voltage, and power characteristics over time of the electrical supply must therefore be controlled within acceptable tolerances. The voltage provided to such lamps is typically in alternating current (AC) form. Allowing any net direct current through a discharge lamp often causes undesirable effects, such as gas migration and accumulation on the lamp electrodes, and saturation of an associated ballast.

The ballast is intended to provide a discharge lamp with a supply of electricity in a form that should remain controlled to have these proper characteristics of voltage and current. Traditionally, these are magnetic ballasts, that include end stage transformers placed in connection with the lamps, and banks of high-voltage capacitors.

Each ballast must power two interfaces. A ballast must have a utility interface and a lamp or load interface. A voltage is provided by the utility, and the ballast will draw a current from this voltage. The power drawn from the utility is supplied, typically without substantial loss, via an output interface to the lamp.

Typical gas discharge lamps must have a controlled current supplied to them because they are substantially constant voltage loads. A function of the ballast is to convert the power supplied at a substantially constant voltage from the utility, to a controlled current and substantially constant voltage which it delivers to the lamp. Although the utility voltage and lamp voltages are alternating current, they are typically substantially constant in the sense that their root mean square (RMS) value is substantially constant, as is familiar to those skilled in the art.

However, these traditional solutions have substantial drawbacks. For example, a traditional ballast may have only one set amount of power it can provide to its lamp, or at best only two or three options for power settings. For another example, a traditional ballast may have only a single voltage setting that is tailor-made for a specific lamp. This means a multi-lamp system will impose separate maintenance and replacement requirements for each of several different ballasts. As another example, traditional ballasts often provide a substantially inaccurate or variable current, with typical inaccuracy of up to 20% or more. As another example, traditional ballasts are often electrically inefficient and convert a significant fraction of current into waste heat, causing the ballasts to operate at high temperature, often leading to additional problems. As another example, traditional ballasts are often bulky, heavy, inconvenient, and expensive. To illustrate, a typical ultraviolet discharge lamp used for curing inks in a printing operation may be twelve feet long, and be supplied by a transformer ballast weighing 700 pounds.

Traditional ballasts also have the disadvantage of inflexibility, in that each ballast must interface directly between a utility voltage supply and a load. The load requires a controlled current for substantially constant voltage. Each ballast must supply sufficient power from the utility supply to cover the peak demand of the corresponding discharge load. In a system of many loads, the total power can be substantial, and the direct and indirect costs of the several individual ballasts are similarly substantial. The greater the system demand for electrical power, the greater the initial capital costs and the ongoing maintenance and power costs. A system of many lamps, each with a corresponding ballast with individual utility interface and lamp interface, also has significant complexity.

For example, a typical discharge lamp system in a printing operation might have nine discharge lamps, each drawing a peak power of 15 kilowatts. In a typical ballast system, each of these lamps would be used with a corresponding ballast having a utility interface function rated for 15 kilowatts, and a discharge lamp interface function rated for 15 kilowatts. Each ballast must be capable of operating for long periods of time, such as hours or days, at 15 kilowatts. The total system therefore has not only a sum of 135 kilowatts of lamp interface capacity, but also a sum of 135 kilowatts of utility interface capacity.

In typical operation, the several lamps tend to draw different amounts of power at different times, so that typically no more than a few lamps draw their peak amount of power at one time. The average power drawn by the lamps might typically be 50 kilowatts with regular relative peaks of around 100 kilowatts, with the absolute peak of 135 kilowatts only reached occasionally and briefly. Much of the ballast capacity, installed and maintained with considerable expense and complexity, therefore spends much of its time idle.

A new solution is therefore highly desired for the problem of delivering electrical power to discharge lamp ballasts. It is further desired that such a solution may introduce greater flexibility and efficiency to fulfilling the power supply requirements of a multiple lamp ballast system, with the ultimate goal of reducing initial and ongoing costs.

SUMMARY OF THE INVENTION

The present invention relates to systems and methods for a multiple discharge load electronic ballast system, and provides solutions to persistent problems in the art including those described above.

One embodiment of the present invention pertains to a multiple discharge load electronic ballast system including a distribution bus and a plurality of electronic ballasts. The distribution bus has a nominal distribution power rating. The plurality of electronic ballasts is operatively coupled to the distribution bus. A respective electronic ballast comprises adaptations for DC voltage control and an alternating current (AC) output, and has a maximum ballast power rating. A sum of the maximum ballast power ratings of the plurality of electronic ballasts is greater than the nominal distribution power rating of the distribution bus.

Another embodiment of the present invention pertains to a multiple discharge load electronic ballast system including a utility interface, a distribution bus, and a plurality of electronic ballasts. The utility interface includes a utility input, a direct current (DC) distribution output, and a nominal distribution power rating at the DC distribution output. The distribution bus is operatively coupled to the DC distribution output. The plurality of electronic ballasts is operatively coupled to the distribution bus. A respective electronic ballast comprises adaptations for DC voltage control and an alternating current (AC) end output and has a maximum ballast power rating at the AC end output. A sum of the maximum ballast power ratings of the plurality of electronic ballasts is greater than the nominal distribution power rating of the utility interface.

Another embodiment of the present invention pertains to a multiple discharge load electronic ballast system, including means for receiving electrical power from a utility source and responsively providing a direct current (DC) distribution voltage having a nominal distribution power; means for distributing the DC distribution voltage to multiple distributed outputs; means for converting the DC distribution voltage at each distributed output into a respective local DC voltage output; and means for inverting each respective local DC voltage output into a respective alternating current (AC) end output having a peak power, wherein the maximum distribution power is less than a sum of the peak power of each of the AC end outputs.

Another embodiment of the present invention pertains to a method of providing electrical power to multiple discharge loads. The method includes the step of converting electrical power from a utility source to a DC distribution output, having a nominal distribution power. The method also includes the step of distributing the DC distribution output to a plurality of electronic ballasts, each of which has a maximum ballast power rating, wherein the nominal distribution power is less than a sum of the maximum ballast power ratings. The method also includes the step of receiving the DC distribution output at each electronic ballast and responsively generating a respective AC ballast output having a voltage and a current that are sufficient for igniting and operating a discharge load. Finally, the method includes the step of providing each of the discharge loads with one of the AC ballast outputs.

Other features and benefits that characterize embodiments of the present invention will be apparent upon reading the following detailed description and review of the associated drawings.

BRIEF DESCRIPTION OF THE DRAWINGS

FIG. 2 is another schematic diagram depicting an illustrative embodiment of a multiple load electronic ballast system in the context of a printing press.

DETAILED DESCRIPTION OF ILLUSTRATIVE EMBODIMENTS

Figure 1:
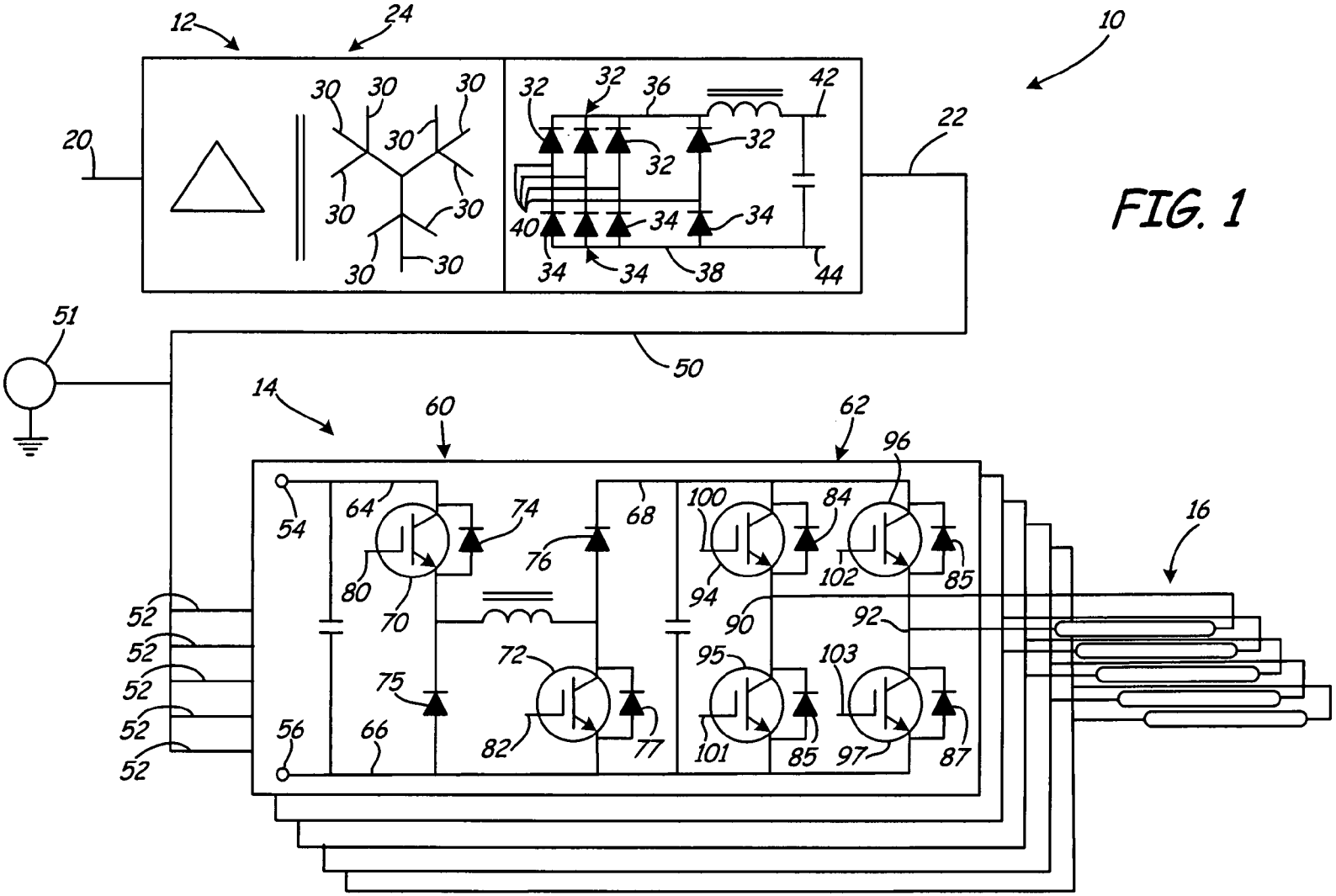
FIG. 1 is a schematic diagram depicting an illustrative embodiment of a multiple load electronic ballast system.

FIG. 1 is a schematic diagram illustrating a multiple discharge load electronic ballast system 10 according to one embodiment of the present invention. System 10 includes a utility interface circuit 12 and a plurality of electronic ballasts 14 for driving respective gas discharge lamps 16 (not integral to this embodiment of ballast system 10). In the embodiment shown in FIG. 1, system 10 includes five individual ballasts 14 for driving five respective gas discharge lamps 16. However, any number of electronic ballasts and gas discharge lamps can be used in alternative embodiments of the present invention. In addition, alternative embodiments of system 10 are adapted to power discharge loads but have no loads connected to them, while other embodiments include a variety of discharge loads besides discharge lamps.

In this embodiment, the functions of utility interface and lamp interface are thereby separated into physically different circuits. The function of utility interface 12 is also centralized in a single device, whether one or many lamps or other discharge loads 16 are operated in the system 10.

Utility interface 12 includes an alternating circuit (AC) to direct current (DC) converter, which is adapted to receive an AC input 20 and responsively generate a DC distribution output 22. The AC input can have any of a variety of incoming voltage levels, such as 115 volts, 208 volts, 480 volts or another voltage lower or higher than this range. The AC input also has a frequency in which the current alternates, such as illustratively 60 Hertz, a typical frequency in North America.

The AC to DC converter includes a transformer 24, a rectifier 26 and an L-C filter 28. In this embodiment, transformer 24 includes a three phase AC input transformer with a multiple phase, such as nine-phase, secondary rectifying circuit, to produce a smooth DC voltage suitable for supplying power to a plurality of DC-DC converters that function as interfaces to individual lamps. Transformer 24 is configured for receiving a 208 volt or 480 volt AC input at 60 Hertz and producing the DC voltage output having a 0.99 power factor. However, any other suitable transformer can be used in other embodiments, which can include any number of input and output phases and any suitable power factor in alternative embodiments. In embodiments having a transformer, the transformer can provide voltage level transformation, multiple taps for world-wide applications, isolation from the utility and related protection from voltage transients, and power factor correction in three-phase applications.

Other embodiments have no transformer. For example, a 480 volt three-phase AC utility voltage, when rectified produces a nominal DC voltage of 780 volts DC. This would be compatible with DC-DC converters that are designed to operate from a nominal 800 volt DC power bus. In the embodiment shown in FIG. 1, the primary side of transformer 24 is coupled to AC input 20, and the secondary side of transformer 24 has nine output taps 30. Each tap output 30 has a respective phase.

Rectifier 18 is configured as an 18-pulse rectifier having nine pairs of diodes 32 and 34 coupled in series with one another between conductors 36 and 38. In each pair, diode 34 has an anode coupled to conductor 38 and a cathode coupled to node 40, and diode 32 has an anode coupled to node 40 and a cathode coupled to conductor 36. Each node 40 is coupled to a respective output tap 30 of transformer 24. Rectifier 26 produces a rectified 18-pulse output on conductors 36 and 38 for each cycle of the AC input.

L-C filter 28 is coupled between conductors 36 and 38 and DC distribution output 22, which is formed by DC output terminals 42 and 44. L-C filter 28 includes inductor L1 and capacitor C1. Inductor L1 is coupled between conductor 36 and DC output terminal 42, and capacitor C1 is coupled in parallel between DC output terminals 42 and 44. L-C filter 28 reduces variation and ensures substantial constancy in the voltage on DC distribution output 22.

The DC distribution output 22 thus provided has a nominal voltage, that is, a voltage within the nominal specifications of utility interface 12 as a nominal DC source, based on the properties of the components, such as rectifier, inductive filter, and capacitive filter. The voltage on DC distribution output 22 varies directly the voltage on utility AC input 20 and varies slightly with varying power drawn by the operatively connected discharge loads such as gas discharge lamps 16. However, the utility voltage is substantially regulated, so the DC distribution voltage on output 22 has a substantially narrow operating range under normal conditions.

The DC distribution output provides a nominal voltage of, as an illustrative example, 800 volts DC. Other voltages occur in other embodiments, such as 500 volts, 1,200 volts, or other voltages higher or lower than these. This single, nominal DC distribution voltage is receivable by any number of electronic ballasts and other components in common.

There are limits to the constancy of the voltage, as is understood by those in the art. For instance, serious disruptions in the AC power input to the utility interface may overcome its, ability to supply the nominal distribution voltage. Various embodiments have differing levels of capacity to ensure providing a DC distribution output at a regulated voltage, based on performance specifications of various embodiments.

While utility interface 12 has been described in significant detail as one illustrative embodiment, it takes other forms in alternative embodiments. For instance, in a different embodiment it provides a DC distribution output that is regulated. In yet another embodiment, utility interface 12 does not include a transformer, as discussed above. In yet another embodiment, utility interface 12 includes a solid state switching converter with high frequency transformer isolation and active power correction, and does not include a rectifier.

DC distribution bus 50 is coupled between DC distribution output 22 and a DC input 52 of each electronic ballast 14. DC distribution bus 50 is also coupled to grounded voltage sensor 51. Each DC input 52 includes a pair of DC input terminals 54 and 56, which are coupled to DC output terminals 42 and 44, respectively, of utility interface circuit 22 through bus 50. Input terminal 54 is coupled to high voltage conductor 64, and input terminal 56 is coupled to low voltage conductor 66.

In the example shown in FIG. 1, each electronic ballast 14 includes a DC to DC converter 60 and a DC to AC inverter 62. DC to DC converter 60 is configured as a step-up/down or "buck-boost" converter having a current mode control. Converter 60 includes input capacitor C2, inductor L2, current mode control transistors 70 and 72, and diodes 74–77. Input capacitor C2 is coupled in parallel between conductors 64 and 66.

Diodes 74 and 75 are coupled in series with one another between conductors 64 and 66. Diode 75 has an anode coupled to conductor 66 and a cathode coupled to node N1, and diode 74 had an anode coupled to node N1 and a cathode coupled to conductor 64. Transistor 70 is coupled in parallel with diode 74 and has a current control terminal 80. Inductor L2 is connected between nodes N1 and N2.

Diodes 76 and 77 are coupled in series between high voltage conductor 68 and low voltage conductor 66. Diode 77 has an anode coupled to conductor 66 and a cathode coupled to node N2. Diode 76 has an anode coupled to node N2 and a cathode coupled to conductor 68. Transistor 72 is coupled in parallel with diode 77 and has a current control terminal 82. Transistors 70 and 72 are insulated gate bipolar junction transistors (IGBTs), in this embodiment. Other suitable types of transistors or switches can also be used in alternative embodiments, such as bipolar junction transistors (BJTs) or MOSFETs for example. Output capacitor C3 is coupled in parallel between conductors 66 and 68.

DC to DC converter 60 receives the DC distribution voltage on input terminals 54 and 56. When transistors 70 and 72 are switched to an "on" state, the input distribution voltage provides energy to inductor L2. When transistors 70 and 72 are switched to an "off" state, the energy stored in inductor L2 is transferred to output capacitor C3. The input-to-output voltage conversion ratio is a function of the duty ratio of transistors 70 and 72. This allows the output voltage to be higher or lower than the input voltage based on the duty ratio, D; i.e., $$V_{OUT} = \frac{V_{IN} * D}{1 - D}$$

In this equation, $V_{OUT}$ represents the local DC voltage of the converter output; $V_{IN}$ represents the converter's incoming voltage, nominally the distribution voltage of the DC distribution bus; and D represents the duty ratio factor. In this embodiment, therefore, a duty ratio factor approaching 0 implies a local DC voltage approaching 0, while a duty ratio factor approaching 1 implies a local DC voltage increasing up to the performance limitations of the particular electronic ballast and associated components. The duty ratio is controlled through current control terminals 80 and 82.

Other voltage control systems are also applicable in which one or the other of transistors 70 and 72 are held on or off for extended periods while the other is switched on and off. Other types of DC to DC converters can also be used in alternative embodiments of the present invention.

Inverter 62 is configured as a square wave inverter, which receives the local DC voltage from DC to DC converter 60 on conductors 66 and 68 and inverts the local DC voltage into an AC square wave output on AC outputs 90 and 92. In this embodiment, inverter 62 includes diodes 84–87 and transistors 94–97.

Diode 84 has an anode coupled to AC output 90 and a cathode coupled to conductor 68. Transistor 94 is coupled in parallel with diode 84 and has a current control terminal 100. Diode 85 has an anode coupled to conductor 66 and a cathode coupled to AC output 90. Transistor 95 is coupled in parallel with diode 85 and has a current control terminal 101. Similarly, diode 86 has an anode coupled to AC output 92 and a cathode coupled to conductor 68. Transistor 96 is coupled in parallel with diode 86 and has a current control input 102. Diode 87 has an anode coupled to conductor 66 and a cathode coupled to AC output 92. Transistor 97 is coupled in parallel with diode 87 and has a current control input 103.

Diodes 84–87 and transistors 94–97 are configured to operate as an "H-bridge" for directing current through AC outputs 90 and 92 with an alternating polarity. When transistors 94 and 97 are "on" and transistors 95 and 96 are "off", current flows through AC outputs 90 and 92 in a first direction. When transistors 96 and 97 are "off" and transistors 95 and 96 are "on", current flows through AC outputs 90 and 92 in a second, opposite direction. Inverter 62 thereby converts the DC voltage across conductors 66 and 68 into an AC voltage across AC outputs 90 and 92. Each pair of AC outputs 90 and 92 are connected to respective electrodes in one of the gas discharge lamps 16.

An H-bridge thereby advantageously enables the flow of positive and negative current going to the corresponding lamp to be adjusted as needed to match and cancel each other, so that there is substantially zero net direct current through the lamp. This can be done by adjusting the time during which the positive current flows compared to the time the negative current flows to maintain a zero average, for example. This advantageously prevents the undesirable effects associated with finite net direct current, such as gas migration and accumulation on the lamp electrodes, and saturation of an associated ballast.

Multiple discharge load electronic ballast system 10 is easily configurable for a wide variety of discharge loads having a variety of input voltage requirements. An embodiment of ballast system 10 is therefore easy to connect to an existing collection of discharge loads, via one set of AC outputs 90, 92 to each discharge load, to provide those discharge loads with the required voltage and current for reliable operation. This includes supplying a voltage and current that conform to the requirements of a respective discharge load for ignition, warm-up, and nominal operation, including compensating for the negative resistance phenomenon after ignition.

Such discharge loads, powered by a system according to the present invention, have a broad range of applications, including for example as UV lamps used for curing inks in printing systems. Many other uses for UV lamps are popular, representative examples of which include curing furniture varnish or heat-sensitive substrates, decontaminating food substances, sterilizing medical equipment or contact surfaces, optically pumping solid state lasers, electrically neutralizing surfaces, inducing skin tanning, and passing through fluorescent coatings to provide visible illumination. Additional uses for discharge lamps in other wavelengths are also popular, such as visible wavelength discharge lamps for providing illumination. Embodiments of the present invention are applicable to improve performance of a collection of discharge loads in any application such as these.

While the example of discharge lamps has been discussed to illustrate one possible type of discharge load to which the present invention is applicable, a wide variety of discharge type loads can advantageously be powered by a multiple discharge load electronic ballast system according to the present invention. For example, a gas laser is a discharge load in which electrodes connected to AC outputs 90 and 92 are operatively coupled to a laser tube.

In some embodiments, the circuitry of ballast 14 is capable of operating at 2,000 volts, 2,200 volts, 2,500 volts, or higher. For example, in one embodiment in which ballast 14 is rated to provide an AC end output of up to 2,500 volts, the DC to DC converter 60 converts an incoming DC distribution voltage of 800 volts DC from the distribution bus 50, to a selected local DC voltage of 2,000 volts DC, which is then passed through inverter 62 to emerge as 2,000 volts AC through AC outputs 90 and 92. This is accomplished even while generating significantly less waste heat than a traditional ballast.

Because each discharge load can be powered by its own ballast based on an electronic converter and inverter, the need for bulky, traditional end-stage transformers is eliminated. For example, in one embodiment of the present invention involving electronic ballasts appropriate to power ultraviolet lamps for curing ink in a printing press, one electronic ballast weighs about 25 pounds, compared to a traditional end-stage transformer of 700 pounds in the same application without the present invention. Among the advantages of the present invention therefore are dramatic reductions in bulk, weight, and inconvenience, and an accompanying reduction in maintenance requirements.

As another advantage, while a traditional ballast system typically requires a utility interface power capacity in the sum of the power ratings of each ballast, the present invention allows a significantly lower nominal utility interface power capacity, of the single interface with its nominal distribution power rating, to be used just as effectively in the same application. This is because in many applications, the peak power drawn by a system of discharge loads at one time is typically significantly less than the sum of the peak power drawn by each discharge load at any point in time. By providing a single nominal distribution output over a distribution bus to all the ballasts and discharge loads in common, this peak power drawn by the system of discharge loads at one time can be provided by the utility interface, operating at lower nominal power than a traditional front end power supply.

For example, in one illustrative system, nine discharge loads each operate with a peak power of 15 kilowatts. Each is supplied by a corresponding ballast, including a DC to DC converter, rated to provide 15 kilowatts over long periods of time in a lamp interface function. The total power rating for the entire system is the sum of these maximum power ratings, or 135 kilowatts. In this typical system, however, the average power drawn by the system is 40 kilowatts, with relatively frequent local peaks of around 80 kilowatts, and only rare and brief absolute peaks of 135 kilowatts.

In this case, an embodiment of the multiple discharge load electronic ballast system can be applied which includes a utility interface with a nominal distribution power rating of 50 kilowatts. That is, the utility interface is optimized for an average power output of 50 kilowatts over indefinitely long periods of time, with capacity to handle relatively frequent spikes of power demand of up to around 100 kilowatts, and occasional, brief power draws of up to 135 kilowatts. This single utility interface supplies the DC distribution output to the ballasts, eliminating the need for each ballast to perform a utility interface function.

This provides entirely for the power needs of the ballasts with a nominal margin, while substantially reducing the required power capacity of the front end of the system. That is, instead of a system of distributed ballasts with a total utility interface function capable of handling 135 kilowatts relatively indefinitely, the system of the present embodiment includes a single, central utility interface with a nominal distribution power rating of 50 kilowatts. This provides that the utility interface is only required to handle 50 kilowatts for indefinite periods of time, with capacity to handle spikes in power demand of up to 135 kilowatts for only brief occasions, in this illustrative embodiment.

Other values of nominal distribution power rating, both higher and lower than 50 kilowatts, occur in alternative embodiments, which also feature other values of temporary peak capacity, both higher and lower than 135 kilowatts.

In this embodiment, the sum of the maximum ballast power ratings is therefore greater than the nominal distribution power rating of the utility interface by 135 kilowatts to 50 kilowatts, or about 63%. In other applications and embodiments, the reduction in the nominal power requirement for the utility interface function may be less than or greater than 63%, such as 25%, 50%, 75%, or some other value lower or higher than these illustrative examples.

Each of these embodiments provides not only ongoing savings in power costs, but also in initial capital costs and ongoing maintenance costs. Because the systems of these embodiments have only a single utility interface regardless of the number of ballasts, they not only cost less but also have far less complexity than a traditional ballast system. Since the discharge lamps draw peak power at different times, these embodiments continue to assure reliable performance by allowing distribution power to be used where it is needed over time.

Because the ballast system also draws its power from a utility source at a single utility interface, the total power is always drawn as a balanced three phase load, in this embodiment. This provides another advantage over some traditional arrangements in which individual ballasts interface with the utility source as single phase devices, often resulting in imbalanced power.

Additionally, because the current control terminals 80 and 82 of converter 60 can be controllably adjusted, the duty ratio and therefore the end voltage of each ballast in a system can be individually controlled, independently of the other electronic ballasts in the system.

Further, because the current control terminals 80 and 82 of converter 60 can be controllably adjusted, the duty ratio and therefore the end voltage of each ballast in a system are individually selectable at any time by the user. This allows the user to select whatever voltage is most appropriate for providing to a particular discharge load from a broad, continuous range; to adjust the voltage provided to the discharge load if the needs of the load change over time; and to reset the output voltage to an entirely new value, for instance if the corresponding discharge load is replaced by a significantly different one, or the ballast is transplanted to a new location or association with a new discharge load. This flexibility reduces the expense and complexity of logistics and inventory needs.

FIG. 2 depicts an embodiment of a multiple discharge load electronic ballast system 10 further including the illustrative context of an offset printing press. System 10 includes a utility interface circuit 12 and a plurality of electronic ballasts 14A, 14B, 14C, 14D for driving respective ultraviolet discharge lamps 16A, 16B, 16C, 16D, which are disposed to cure inks (not shown) deposited on paper 130 by roller banks 136A, 136B, 136C, 136D.

Utility interface 12 is adapted to receive an AC input 20 and responsively generate a DC distribution output 22. DC distribution bus 50 is coupled between DC distribution output 22 and electronic ballasts 14A–D. Ultraviolet discharge curing lamp 16A is operatively coupled to electronic ballast 14A through AC outputs 90A and 92A. Ultraviolet discharge curing lamps 16B–D are likewise operatively coupled to electronic ballasts 14B–D through AC outputs 90B–D and 92B–D, respectively.

Roller banks 136A–D are each assigned a different color ink to deposit on paper 130. Roller bank 136A deposits black ink; roller bank 136B deposits cyan ink; roller bank 136C deposits magenta ink; and roller bank 136D deposits yellow ink. Paper 130 passes through roller banks 136A–D starting with roller bank 136A for the deposit of black ink, and goes from darker to lighter inks, ending with the deposit of yellow ink at roller bank 136D. The combination of these four inks provides for full color printing. The passage of paper 130 is aided by spool roller 132 and chill roller 134. Chill roller 134 is cooled by an internal flow of cold water, and helps to set the inks on paper 130. This is a typical arrangement for an offset printing press. Many other arrangements occur in different embodiments and contexts, to which the present invention is similarly applicable.

Roller bank 136A includes impression cylinder 140A, offset blanket cylinder 142A, lithoplate cylinder 144A, ink rollers 150A and 152A, ink fountain 156A, water rollers 160A and 162A, and water reserve 166A. Lithoplate cylinder 144A rotates clockwise in the perspective depicted, so that a point on the lithoplate cylinder encounters water roller 160A, then ink roller 150A, then offset blanket cylinder 142A. The image areas of lithoplate cylinder 144A will retain black ink from ink roller 150A, while the non-image areas of lithoplate cylinder 144A are kept free of ink by water applied by water roller 160A. Water is fed from water reserve 166A via water roller 162A to water roller 160A, and therefrom to lithoplate cylinder 144A. Black ink is fed from ink fountain 156A via ink roller 152A to ink roller 150A, and therefrom to lithoplate cylinder 144A.

The inked images from lithoplate cylinder 144A are then transferred to offset blanket cylinder 142A, typically made of rubber, for example. Offset blanket cylinder 142A then transfers the images of black ink to paper 130, which is pressed between offset blanket cylinder 142A and impression cylinder 140A. Offset blanket cylinder 142A rotates counterclockwise while impression cylinder 140A rotates clockwise, as seen in this perspective. Then, to ensure that the ink is protected from running or smudging later in the printing process, the paper 130 with fresh images in black ink passes under ultraviolet discharge curing lamp 16A, which rapidly cures the ink as it passes thereunder, and which is powered by electronic ballast 14A.

The paper then passes from roller bank 136A through roller banks 136B, 136C, and 136D, which function similarly to apply cyan, magenta, and yellow ink, respectively. After each pass of paper 130 through a respective pair of offset blanket cylinders 142B–D and impression cylinders 140B–D, it encounters the respective ultraviolet discharge curing lamps 16B–D, which cure the cyan, magenta, and yellow ink, respectively.

This multiple discharge load electronic ballast system therefore provides substantial advantages, including in front end power supply 12 and in ballasts 14A–D. For example, in nominal operation, ultraviolet discharge curing lamps 16A–D typically draw power in varying rates over time. When one of lamps 16A–D is operating at high power, at least one other lamp 16A–D is typically operating at lower power. Lamps 16A–D therefore have a peak operating power that is significantly less than the sum of the peak operating power of each lamp 16A–D. Since each lamp 16A–D is powered by a ballast 14A–D, this means the peak operating power of the system 10 is also significantly less than the sum of the maximum power ratings of each ballast 14A–D. This system 10 therefore allows for a nominal power rating to be provided by the utility interface 12 to ballasts 14A–D that is less than the sum of the maximum power ratings of each ballast 14A–D. This provides for substantial savings in initial capital costs and in ongoing power and maintenance costs.

As another example, electronic ballasts 14A–D are far smaller and lighter than traditional ballasts for offset printing presses, because of their innovations such as semiconductor-based converters and inverters capable of operating at the typically high voltages required for discharge curing lamps 16A–D, such as 2,000 volts. In this illustrative embodiment, electronic ballasts 14A–D weigh about 25 pounds each, compared to around 700 pounds for traditional end-stage transformers for an offset printing press.

Additionally, because electronic ballasts 14A–D are each adapted to provide an AC end voltage at AC outputs 90A–D and 92A–D that is individually selectable from a wide range of voltages, only one type of ballast is needed for the system 10, providing substantial advantages such as greatly simplifying inventory and logistics.

Although the present invention has been described with reference to certain representative embodiments, workers skilled in the art will recognize that these embodiments are illustrative of just a few examples contained within the metes and bounds of the invention, and that changes may be made in form and detail without departing from the spirit and scope of the invention, particularly in matters of structure and arrangement of parts within the principles of the present invention, to the full extent indicated by the broad, general meaning in which the appended claims are expressed.

For example, the particular elements may vary depending on the particular application for the multiple discharge load electronic ballast system, while maintaining substantially the same functionality, without departing from the scope and spirit of the present invention.

What is claimed is:

1. A multiple discharge load electronic ballast system, comprising:

a utility interface comprising a utility input, a direct current (DC) distribution output, and a nominal distribution power rating at the DC distribution output;

a distribution bus, operatively coupled to the DC distribution output; and a plurality of electronic ballasts, operatively coupled to the distribution bus, wherein a respective electronic ballast comprises adaptations for respective local DC voltage control and an alternating current (AC) end output and has a maximum ballast power rating at the AC end output, wherein a sum of the maximum ballast power ratings of the plurality of electronic ballasts is greater than the nominal distribution power rating of the utility interface.

2. The multiple discharge load electronic ballast system of claim 1, wherein the sum of the maximum ballast power ratings is greater than the nominal distribution power rating by at least 25 percent.

3. The multiple discharge load electronic ballast system of claim 2, further wherein the sum of the maximum ballast power ratings is greater than the nominal distribution power rating by at least 50 percent.

4. The multiple discharge load electronic ballast system of claim 1, wherein the adaptations for respective local DC voltage control of the electronic ballast comprise a DC to DC converter, capable of providing a respective local DC voltage.

5. The multiple discharge load electronic ballast system of claim 4, wherein the DC to DC converter is further capable of providing the local DC voltage at over 2,000 volts.

6. The multiple discharge load electronic ballast system of claim 4, wherein the DC to DC converter comprises a step-up/down converter.

7. The multiple discharge load electronic ballast system of claim 4, wherein the adaptations for the AC end output comprise an inverter, operatively coupled to the DC to DC converter, and capable of receiving the local DC voltage from the DC to DC converter, and inverting the local DC voltage to provide an AC end voltage at the AC end output.

8. The multiple discharge load electronic ballast system of claim 7, wherein the respective electronic ballast is further adapted such that the AC end output conforms to voltage and current requirements for ignition and operation of a discharge load.

9. The multiple discharge load electronic ballast system of claim 7, wherein the respective electronic ballast is further adapted to allow for the individual selection of a regular operating power of the respective AC end output, independently of other electronic ballasts of the plurality.

10. The multiple discharge load electronic ballast system of claim 7, wherein the inverter is further capable of inverting the local DC voltage at over 2,000 volts.

11. The multiple discharge load electronic ballast system of claim 7, wherein the inverter comprises a square wave inverter.

12. The multiple discharge load electronic ballast system of claim 7, wherein the DC to DC converter is further adapted such that the AC end voltage is individually controllable, independently of other electronic ballasts of the plurality.

13. The multiple discharge load electronic ballast system of claim 7, wherein the DC to DC converter is further adapted such that the AC end voltage is individually selectable from a substantially continuous range of voltages.

14. The multiple discharge load electronic ballast system of claim 1, wherein the utility interface comprises a multiple phase transformer coupled to the utility input and a rectifier coupled between the multiple phase transformer and the DC distribution output.

15. The multiple discharge load electronic ballast system of claim 14, wherein the utility interface is further adapted to provide the distribution output at from 600 to 1,000 volts.

16. The multiple discharge load electronic ballast system of claim 1, further comprising a voltage sensor operatively coupled to the distribution bus.

17. The multiple discharge load electronic ballast system of claim 1, wherein each of the electronic ballasts comprises a DC to DC step-up/down converter operatively coupled to an output of the distribution bus, and a DC to AC square wave inverter operatively coupled to the DC to DC step-up/down converter and to a respective AC end output.

18. The multiple discharge load electronic ballast system of claim 1, further comprising a plurality of ultraviolet discharge lamps operatively connected to the electronic ballasts.

19. The multiple discharge load electronic ballast system of claim 18, further comprising a printing system within which the ultraviolet discharge lamps are adapted to cure inks.

20. A multiple discharge load electronic ballast system, comprising:

means for receiving electrical power from a utility source and responsively providing a direct current (DC) distribution voltage having a nominal distribution power;

means for distributing the DC distribution voltage to multiple distributed outputs;

means for converting the DC distribution voltage at each distributed output into a respective local DC voltage output; and means for inverting each respective local DC voltage output into a respective alternating current (AC) end output having a peak power, wherein the nominal distribution power is less than a sum of the peak power of each of the AC end outputs.

21. The multiple discharge load electronic ballast system of claim 20, wherein the nominal distribution power is less than the sum of the peak power of each of the AC end outputs by at least 25 percent.

22. The multiple discharge load electronic ballast system of claim 21, further wherein the nominal distribution power is less than the sum of the peak power of each of the AC end outputs by at least 50 percent.

23. The multiple discharge load electronic ballast system of claim 20, wherein each respective AC end output is capable of providing a voltage and a current that conform to the requirements for ignition and operation of a discharge load.

24. The multiple discharge load electronic ballast system of claim 20, wherein each means for converting the DC distribution voltage is capable of providing the respective local DC voltage output at over 2,000 volts.

25. The multiple discharge load electronic ballast system of claim 20, wherein the means for converting the DC distribution voltage is adapted such that the respective local DC voltage is individually selectable, independently of others of the multiple distributed outputs.

26. The multiple discharge load electronic ballast system of claim 20, wherein the means for receiving electrical power from the utility source and responsively providing a direct current (DC) distribution voltage is adapted to provide the DC distribution voltage at from 600 to 1,000 volts.

27. A method of providing electrical power to multiple discharge loads, comprising the steps of:

converting electrical power from a utility source to a DC distribution output, having a nominal distribution power;

distributing the DC distribution output to a plurality of electronic ballasts, each of which has a maximum ballast power rating, wherein the nominal distribution power is less than a sum of the maximum ballast power ratings;

receiving the DC distribution output at each electronic ballast, converting the DC distribution output into a respective local DC voltage output and responsively generating a respective AC ballast output having a voltage and a current that are sufficient for igniting and operating a discharge load; and providing each of the discharge loads with one of the AC ballast outputs.

28. The method of claim 27, wherein the nominal distribution power is less than the sum of the maximum ballast power ratings by at least 25 percent.

29. The method of claim 28, further wherein the nominal distribution power is less than the sum of the maximum ballast power ratings by at least 50 percent.

30. The method of claim 27, further comprising the step of individually selecting the voltage of one of the AC ballast outputs.

31. The method of claim 27, wherein the step of responsively generating the respective AC ballast output comprises inverting the respective local DC voltage output into the respective AC ballast output.

32. A multiple discharge load electronic ballast system, comprising:

a distribution bus having a nominal distribution power rating; and a plurality of electronic ballasts, operatively coupled to the distribution bus, wherein a respective electronic ballast comprises adaptations for respective local DC voltage control and an alternating current (AC) output, and has a maximum ballast power rating; and wherein a sum of the maximum ballast power ratings of the plurality of electronic ballasts is greater than the nominal distribution power rating of the distribution bus.

* * * * *